US009480868B2

(12) United States Patent
Mikota et al.

(10) Patent No.: US 9,480,868 B2
(45) Date of Patent: Nov. 1, 2016

(54) DEVICE FOR USE IN FIRE-FIGHTING OPERATIONS

(71) Applicant: ROSENBAUER INTERNATIONAL Aktiengesellschaft, Leonding (AT)

(72) Inventors: Josef Mikota, Linz (AT); Johann Wieser, Wolfsbach (AT)

(73) Assignee: Rosenbauer International Aktiengesellschaft, Leonding (AT)

( * ) Notice: Subject to any disclaimer, the term of this patent is extended or adjusted under 35 U.S.C. 154(b) by 0 days.

(21) Appl. No.: 14/712,967

(22) Filed: May 15, 2015

(65) Prior Publication Data

US 2015/0246251 A1 Sep. 3, 2015

Related U.S. Application Data

(62) Division of application No. 12/450,749, filed as application No. PCT/AT2008/000137 on Apr. 14, 2008, now Pat. No. 9,061,168.

(30) Foreign Application Priority Data

Apr. 12, 2007 (AT) ..... A 564/2007

(51) Int. Cl.
*A62C 31/22* (2006.01)
*A62C 31/28* (2006.01)
*A62C 31/24* (2006.01)

(52) U.S. Cl.
CPC ..... *A62C 31/28* (2013.01); *A62C 31/22* (2013.01); *A62C 31/24* (2013.01)

(58) Field of Classification Search
CPC ..... A62C 31/24; A62C 31/22; A62C 31/28
USPC ..... 169/51, 52, 24, 72, 66, 67, 53; 239/271, 239/272; 91/417 R
See application file for complete search history.

(56) References Cited

U.S. PATENT DOCUMENTS 2,547,334 A 4/1951 Marshall
4,708,088 A 11/1987 Purvis et al.
(Continued)

FOREIGN PATENT DOCUMENTS

CN 2487398 Y 4/2002
DE 10 2004 039 973 A1 3/2005
(Continued)

OTHER PUBLICATIONS

International Search Report of PCT/AT2008/000137, mailed Oct. 6, 2008.

*Primary Examiner* — Jason Boeckmann
(74) *Attorney, Agent, or Firm* — Collard & Roe, P.C.

(57) ABSTRACT

A fire-fighting device includes an extinguishing device arranged on an end region of a cantilever arm and is adjustable in at least one spatial direction. A penetration fixture is adjustable relative to the extinguishing device and has a double-acting pressure cylinder subjectable to pressure by a pressure medium from a hydraulic system via at least one control valve. The cylinder has a tubular continuous piston rod having a penetration tool on a protruding end having a through-hole and a nozzle head. At another end, the piston rod is connected in line with a supply mechanism for an extinguishing medium. Pressure accumulator elements are in fluid communication with a pressure chamber of the pressure cylinder for extending the penetration tool and with a return line for the pressure medium from another pressure chamber for retracting the penetration tool.

10 Claims, 6 Drawing Sheets

(56) References Cited

U.S. PATENT DOCUMENTS

| | | | | |
|---|---|---|---|---|
| 4,742,220 | A | 5/1988 | Beyor | |
| 5,050,380 | A | 9/1991 | Jonsson | |
| 5,211,245 | A | 5/1993 | Relyea et al. | |
| 5,301,756 | A | 4/1994 | Relyea et al. | |
| 5,839,664 | A | 11/1998 | Relyea | |
| 6,095,028 | A | 8/2000 | Lämås et al. | |
| 6,130,437 | A * | 10/2000 | Cerny | G01B 11/25 250/559.4 |
| 6,340,060 | B1 | 1/2002 | Larsson et al. | |
| 6,446,731 | B1 | 9/2002 | Sorosky | |
| 6,755,259 | B2 * | 6/2004 | Peltola | A62C 31/22 169/24 |
| 6,951,103 | B2 | 10/2005 | Berthod et al. | |
| 7,034,389 | B2 | 4/2006 | Morimoto et al. | |
| 7,055,613 | B1 | 6/2006 | Bissen et al. | |
| 7,219,779 | B2 | 5/2007 | Bauer et al. | |
| 7,438,239 | B2 * | 10/2008 | Woodson | A62C 31/22 169/54 |
| 7,530,403 | B2 | 5/2009 | Cano | |
| 7,611,075 | B2 | 11/2009 | Relyea et al. | |
| 2005/0198949 | A1 | 9/2005 | Bitter | |
| 2007/0034389 | A1 | 2/2007 | Relyea et al. | |

FOREIGN PATENT DOCUMENTS

| | | | |
|---|---|---|---|
| EP | 1 369 145 | A1 | 12/2003 |
| EP | 1 508 461 | A1 | 2/2005 |
| SU | 860777 | A1 | 9/1981 |
| SU | 1718983 | A1 | 3/1992 |

* cited by examiner

DEVICE FOR USE IN FIRE-FIGHTING OPERATIONS

CROSS REFERENCE TO RELATED APPLICATIONS

This application is a divisional of and Applicants claim priority under 35 U.S.C. §§120 and 121 of U.S. application Ser. No. 12/450,749 filed on Nov. 3, 2009, which application is a national stage application under 35 U.S.C. §371 of PCT Application No. PCT/AT2008/000137 filed on Apr. 14, 2008, which claims priority under 35 U.S.C. §119 from Austrian Patent Application No. A 564/2007 filed on Apr. 12, 2007, the disclosures of each of which are hereby incorporated by reference. A certified copy of priority Austrian Patent Application No. A 564/2007 is contained in parent U.S. application Ser. No. 12/450,749. The International Application under PCT article 21(2) was not published in English.

BACKGROUND OF THE INVENTION

1. Field of the Invention

The invention relates to a device for use in fire-fighting operations as well as a penetration device.

2. Description of the Related Art

Known from the document EP 1 369 145 A1 is a device for fire fighting comprising a penetration device disposed on a telescopable cantilever arm of an emergency vehicle. This has a linearly adjustable penetration tool for piercing through a cell structure and introducing a fire-retardant medium into an interior space of the cell structure through the tubular penetration tool which is connected in line to a fire-retardant medium tank. The linear drive of the penetration tool is effected by means of a pre-tensioned spring arrangement to achieve a high impact velocity of the penetration tool on the cell structure in order to reliably achieve piercing. A measure which facilitates the process in the known device is the application of a defined contact force of the penetration device on the cell structure in order to achieve a pre-stress before the penetration process. A pressure cylinder which can be acted upon with a pressure medium instead of the spring drive as a linear drive for the penetration tool can also be deduced from this document.

Known from the document U.S. Pat. No. 5,839,664 A is a fire-extinguishing device comprising an apparatus carrier disposed on a telescopable cantilever arm which is equipped with a penetration device and a spray unit for dispensing a fire-retardant medium. The mounting of the penetration device and the spray unit on the apparatus carrier makes it possible to achieve an independent relative adjustment between the penetration device with the penetration tool and the spray unit by means of drives so that the equipment required for the application in each case can be brought into optimal position and without any disturbing influence from the other equipment but also to avoid damage to the equipment not required. To this end, the device has a first motor for adjusting the spray unit from a first position into its second position and a control and monitoring device which prevents any mutual influence of the movement of both devices.

Known from the further document U.S. Pat. No. 7,055,613 A is a fire-extinguishing device on a boom system of a fire-fighting vehicle which consists of a penetrating device carrying a fire-extinguishing medium. The penetration device is disposed in a rolled beam which is pivotally mounted in an end region of the boom arm and which mounts linearly adjustably a tubular penetration tool. The penetration tool is supplied with the fire-extinguishing medium and its end region is designed for piercing a wall and also forms a nozzle head. The arrangement of the penetration tool inside the cross bar mounted on the articulated arm and pivotably by means of a pivoting drive allows a direction of action of the penetration tool to be optimally aligned with regard to the geometrical conditions of a wall to be penetrated and also with regard to optimising the angular position between the boom arm and the line of action of the penetration tool to reduce the reaction forces on the boom arm during the penetration process.

SUMMARY OF THE INVENTION

The object of the invention is to provide a device for use in fire-fighting operations as well as a penetration fixture for the device for use in fire-fighting operations by which means set-up times in a particular application of the device for use in fire-fighting operations are minimized and a rapid and efficient procedure is effected by means providing an assessment of the situation. This object of the invention is achieved by features as described herein. In one embodiment according to the invention, at least one pressure accumulator element is in fluid communication with a pressure chamber of the pressure cylinder that brings about an extending motion of the penetration tool when pressure is applied by the pressure medium. Additionally in this embodiment, at least one further pressure accumulator element is in fluid communication with a return line for the pressure medium from a pressure chamber that causes the penetration tool to be retracted when pressure is applied. The surprising advantage here is that a storage capacity for the pressure medium assigned to the pressure chambers is immediately created and for the extension-side action upon the pressure chamber of the penetration fixture the pressure medium under operating pressure for a high acceleration and final velocity of the penetration tool forms a pre-stressing potential, which is provided without substantial pressure loss due to line loss and a storage capacity for the pressure medium to be expelled exists on the return flow side, with the result that a flow resistance in the return line does not act against the extension movement of the penetration tool.

Further embodiments are advantageous in which in a retracted rest position of the penetration tool, at least the pressure chamber of the pressure cylinder is subjected to an operating pressure from the hydraulic system via a pressure line and via a bypass line. A control valve which blocks the return flow of the pressure medium from the pressure chamber into the return line if necessary is located downstream of the pressure accumulator element in the outflow direction of the pressure medium. These embodiments are advantageous since the penetration tool can thus be activated rapidly from the pre-stressed starting position for a penetration process.

As a result of the advantageous embodiment in which flow connections between the pressure chambers of the pressure cylinder and the pressure accumulator elements have a larger flow cross-section than a flow cross-section of the return line, a rapid expulsion of the pressure medium from the pressure chamber applicable for the retraction movement is achieved.

Embodiments are also advantageous in which piston active areas associated with the pressure chambers are different and the piston active area which is subjected to the pressure medium for an extension movement of the penetration tool is smaller than the piston active area which is acted upon for a retraction movement. A control valve can be disposed in the pressure line, with the control valve being in fluid communication with the pressure chamber which effects the retraction movement via a feed line. The pressure chamber which effects the extension movement is in direct fluid communication with the pressure line via a bypass line. A switching valve operatively connected to the control valve is provided for triggering the control valve. These further features are advantageous, since the penetration tool is thereby positioned in a retracted starting position and can be activated immediately for the penetration process by a switching process by simultaneously triggered control and switching valves.

Further advantageous embodiments include further features of the hydraulic system, in particular the pressure cylinder, including a damping member for end-position damping of the extension movement of the penetration tool, whereby the damping member can be formed by an end-position throttle. Embodiments with these features effectively avoid shock loadings of the penetration fixture and furthermore also reaction forces on a cantilever system carrying the device for use in fire-fighting operations.

According to another advantageous embodiment in which the operating pressure of the hydraulic system is between 150 bar and 400 bar, preferably 210 bar, a sufficiently high penetrating action of the penetration fixture is achieved with a dimension which is kept small and therefore gives a low weight of the penetration fixture.

Further embodiments include features of an apparatus carrier being disposed on the cantilever arm, which carrier pivotably mounts the penetration fixture and pivotably mounts a spray unit head having a spray unit tube about lifting axes running perpendicular to a tilt-up plane of the cantilever arm, running coaxially or running parallel to one another. The spray unit head can be rotatable about an axis of rotation running perpendicular to the lifting axes. The apparatus carrier can be mounted in a pivot bearing arrangement so that it can pivot about the lifting axis by means of a lifting drive, e.g. pressure cylinder, hydraulic or electrical rotating drive etc. on the cantilever arm. Embodiments with these features are furthermore advantageous because as a result, the penetration fixture and the spray unit tube for dispensing the fire-extinguishing medium can be used independently of one another and without having a mutually interfering influence, with the result that an effective actuation which can be adapted to the particular circumstances is possible and preferably the apparatus required in each case can be deployed without the apparatus not required having an interfering influence.

As a result of the advantageous embodiment in which the penetration fixture and/or the spray unit head with the spray unit tube are arranged directly on the cantilever arm so that they can pivot about lifting axes running concentrically or parallel to one another and perpendicular to the tilt-up plane, a light-weight construction is achieved with the result that the loading of the support arm equipped with the fire-extinguishing and penetration apparatus is reduced and this leads to a reduction in the weight of the cantilever.

The embodiment is also advantageous in which respectively one lifting drive, e.g. pressure cylinder, hydraulic or electrical rotary drive is provided for the penetration fixture and the spray unit tube, thus providing variants for the rotary and lifting drives for adaptation to special requirements.

However, an embodiment is also advantageous in which a protruding end of the penetration tool is configured as a mandrel-like nozzle head having radial outlet openings for the fire-extinguishing medium, whereby an optimization of the penetration tool with regard to penetration process and expulsion of the fire-extinguishing medium is achieved for an efficient fire-extinguishing process.

Due to the embodiment in which the pressure accumulator elements are formed by bubble, membrane or piston storage devices, technically proven and functional hydraulic components for problem-free long-term operation are put into use.

Embodiments are also advantageous in which a camera is disposed at an end region of the cantilever arm. The camera can be fastened on the cantilever arm so that it can be pivoted and rotated by remote control. The camera is connected in communication with a control and/or monitoring device. With these embodiments, an exact positioning of the equipment is achieved from an operating location without direct visual connection to the deployment location.

Embodiments are also advantageous in which a detection device having measuring and/or scanning means is disposed at one end of the penetration fixture or the pressure cylinder. The detection device can be connected in communication with the control and/or monitoring device. With these embodiments, before the penetration process, the position of the penetration fixture in relation to an object to be penetrated is optimized in an automated sequence, thus avoiding complications during the penetration process and repeated attempts due to failed processes.

Finally, however, a further development is advantageous in which the detection device is formed by a light beam emitter and a reflection receiver disposed on the pressure cylinder, which are connected in communication with an evaluation switching module of the control and/or monitoring device, because a technically simple solution is achieved whereby from measurements of the reflection of a light spot produced on a surface of a wall to be penetrated by means of a light beam an optimal angle of incidence of about 90° is achieved.

The object of the invention is, however also independently achieved by a penetration fixture having a linear drive for a tubular penetration tool provided with a nozzle head for dispensing a fire-extinguishing medium from a fire-extinguishing medium supply device. The penetration tool, in particular the nozzle head, is provided with at least one receptacle which is recessed to a surface, in which a communication and/or detection means is disposed. The communication and/or detection means is connected in communication with the control and/or monitoring device. In this embodiment, the penetration tool especially one for the dispensing of a fire-extinguishing medium after penetrating a wall is fitted with communication and/or detection means which deliver essential information of a task force or operational force for an optimal deployment.

Embodiments are also advantageous in which the communication and/or detection means is formed by a loudspeaker or by a microphone, whereby verbal exchange of information is achieved.

An advantageous embodiment is also possible in which the communication and/or detection means is formed by a camera, preferably by a lens and a CCD chip. With this embodiment, the task force or the operator at a controller, for example, at a control panel with a screen, is given an overview of the situation in the interior of a room unit, with the result that an efficient and rapid deployment for damage limitation is achieved.

An embodiment is also advantageous in which the communication and/or detection means is formed by a sensor, e.g. temperature measuring sensor, gas probe etc., whereby information for assessment of the ambient conditions of persons trapped in a room unit who need to be rescued is made available to the task form and rescue measures can then be coordinated.

An embodiment is also possible in which the communication and/or detection means is formed by a light source disposed in the receptacle, in particular an LED, whereby additional illumination is achieved in the area near the penetration tool which has penetrated into the room unit.

In other advantageous embodiments the camera, in particular the lens, is mounted adjustably in a central hole running coaxially to the longitudinal central axis, preferably of a penetrating insert. The camera, in particular the lens, is drivingly connected to an adjusting drive disposed at one end of the piston rod, by means of a protective tube which accommodates a data line and crosses the piston rod in the longitudinal direction. In these embodiments, a penetrating tool having its dimensions kept small is achieved with the result that the application of force for a penetration process is minimized and smaller reaction forces act on the device for use in fire-fighting operations and an adjustment of the camera is achieved between a withdrawn position during the penetration process and an advanced position to achieve an adequate field of view.

Finally, however, other embodiments include the communication and/or detection means being connected in line with the control and/or monitoring device and include the communication and/or detection means and/or the light sources being connected in line with an energy source. These embodiments are also advantageous whereby simple control and operation and in addition data recordings for subsequent analysis are achieved without impairing activities of an operator.

For a better understanding of the invention, this is explained in detail with reference to the exemplary embodiments shown in the figures.

DETAILED DESCRIPTION OF THE PREFERRED EMBODIMENTS

Figure 1:
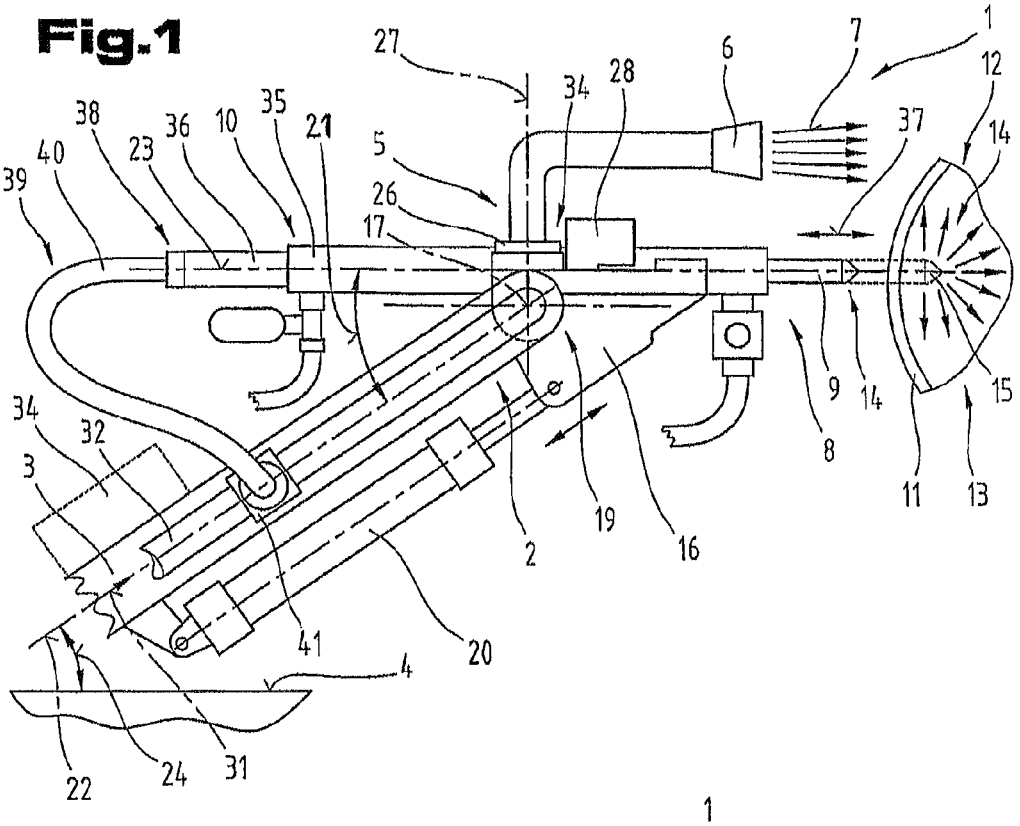
FIG. 1 shows a device for use in fire-fighting operations according to the invention with an extinguishing device on a cantilever arm.

It should be noted by way of introduction that in the variously described embodiments, the same parts are provided with the same reference numerals or the same component designations, wherein the disclosures contained in the entire description can be appropriately applied to the same parts having the same reference numerals or the same component designations. The positional information selected in the description such as, for example, top, bottom, lateral etc. are related to the figure being directly described and depicted and in the event of a change in position, can be appropriately applied to the new position. Furthermore, individual features or feature combinations from the different exemplary embodiments shown and described can also by themselves constitute independent, inventive solutions or solutions according to the invention.

All the information on ranges of values in the present description are to be understood such that these comprise any and all partial ranges thereof, for example, the information 1 to 10 is to be understood such that all partial regions starting from the lower limit 1 and the upper limit 10 are included, i.e. all partial regions begin with a lower limit of 1 or greater and end with an upper limit of 10 or less, e.g. 1 to 1.7 or 3.2 to 8.1 or 5.5 to 10.

Figure 2:
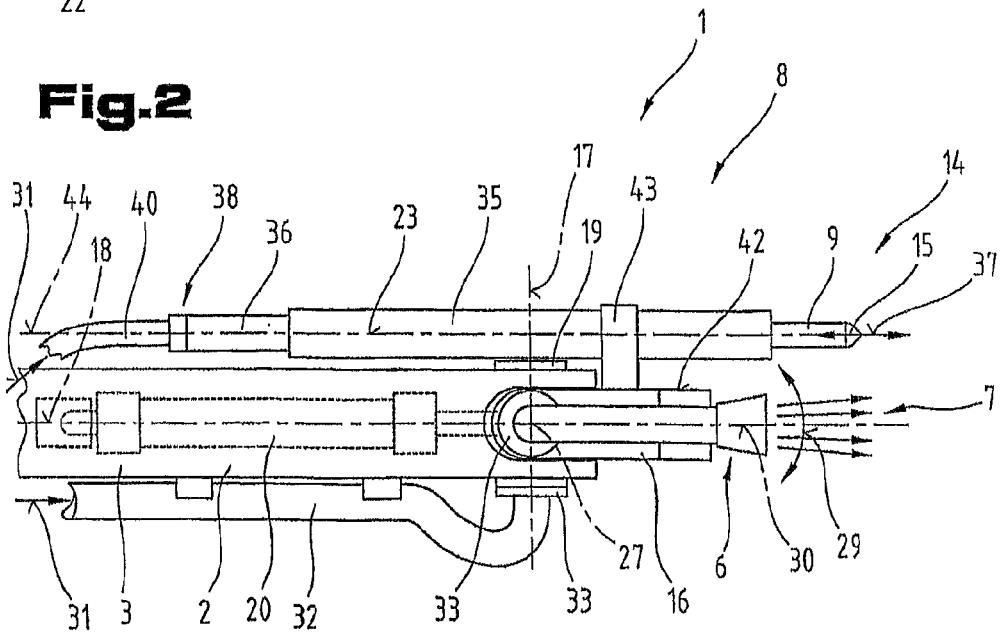
FIG. 2 shows the device for use in fire-fighting operations according to FIG. 1 in plan view.

FIGS. 1 and 2 show an extinguishing device 1 at an end region 2 of a cantilever arm 3. The cantilever arm 3 is, for example and not further shown, a part of a telescopable articulated-arm cantilever which is pivotable on a device for use in fire-fighting operations about an axis running perpendicular to a standing surface 4 and which can be actuated to be raised or lowered about a horizontally, running axis and which is controllable by means of a control device of the device for use in fire-fighting operations.

The extinguishing device 1 comprises a spray unit head 5 with a spray unit tube 6 for dispensing an extinguishing medium as is indicated by arrows 7. Thus, fire fighting can be carried out at a freely accessible scene of fire.

Furthermore, the extinguishing device 1 has a penetration fixture 8. The penetration fixture 8 comprises a lance-shaped penetration tool 9 that is designed by means of a linear drive 10 for a process of penetrating a wall structure 11 in order to achieve penetration of the penetration tool 9 in an interior space 12 enclosed by the wall structure 11, e.g. of a means of transport, in particular a fuselage 13 as fast as possible in a case of deployment. The penetration tool 9 is tubular for through-passage of the extinguishing medium and is provided with a nozzle head 15 in a protruding end 14, whereby after penetrating the wall structure 11, a fire-fighting process can be carried out by spraying the extinguishing medium in the interior 12 of the room unit 13.

The spray unit head 5 with the spray unit 6 and the penetration fixture 8 with the penetration tool 9 according to the exemplary embodiment shown are mounted on an apparatus carrier 16 which is located in the end region 2 of the cantilever arm 3.

The apparatus carrier 16 with the spray unit head 5 and the penetration fixture 8 is mounted on the cantilever arm 3 in a pivot bearing arrangement 19 about a lifting axis 17 running approximately parallel to the standing surface 4, which axis runs approximately perpendicular to a tilt-up plane 18 approximately vertical to the standing surface 4.

The pivoting movement about the lifting axis 17 is controlled, for example, by a lifting drive 20 by a double-acting pressure cylinder that can be subjected to a pressure medium, wherein the pressure cylinder is articulated to the cantilever arm 3 on the one hand and to the apparatus carrier 16 on the other hand. Thus, an angle, according to double arrow 21, between a longitudinal central axis 22 of the cantilever arm 3 and a longitudinal central axis 23 of the penetration fixture 8 can be varied depending on an alignment angle, according to double arrow 24, of the cantilever arm 3 in order to select an optimum angle of incidence 25 for the penetration tool 9 on the wall structure 11 which as far as possible should form a right angle to achieve an optimal penetration effect in order to prevent any sliding of the penetration tool 9 as a consequence of deformation or resilience of the cantilever arm 3 or of the telescopic articulated arm arrangement of devices for use in fire-fighting operations, which are constructed in lightweight design for reasons of weight, or as a consequence of any resilience of the wall structure 11.

The spray unit head 5 with the spray unit tube 6 is rotatable about an axis of rotation 27 running perpendicularly to the lifting axis 17 and by means of a rotary drive 28 in a swivel arrangement 26 on the apparatus carrier 16, according to double arrow 29, whereby the direction of ejection of the extinguishing medium, according to arrows 7, can be aligned onto the respective scene of fire, i.e. a longitudinal central axis 30 of the spray unit tube 6 is pivotable about the axis of rotation 27.

It is also expedient to pivot the spray unit tube 6 with regard to the deployment of the penetration fixture 8, in which case an angle of rotation is fundamentally not limited.

The extinguishing medium, according to arrow, 31, is supplied via a conduit 32, for example, disposed laterally on the cantilever arm 3 and via a first rotary distributor 33, which is disposed coaxially to the lifting axis 17 and which connects the conduit 32 to the spray unit head 7 and by means of a second rotary distributor 33, which is disposed coaxially to the axis of rotation 27. Due to this configuration, the pressure medium can be guided, according to arrow 31, independently of the position of the apparatus carrier 16 and the spray unit tube 6 from the conduit 32 mounted rigidly on the cantilever arm 3.

The penetration fixture 8 is formed by a double-acting cylinder 35 which can be acted upon by the pressure medium from a hydraulic system 34, and has a continuous tubular piston rod 36. As has already been described, at the end 14 the piston rod 36 is provided with the nozzle head 15, which is configured to be lance-shaped for penetrating the wall structure 11. The pressure cylinder 35 forms the linear drive 10 for adjusting the penetration tool 9, i.e. the piston rod 36, according to double arrow 37. At the opposite protruding end 38, a line 39 is connected to the piston rod 36, in particular a pressure hose 40 for supplying the extinguishing medium from the conduit 32. The pressure hose 40 is connected to the conduit 32 with an interposed, preferably remotely triggerable, valve 41.

The pressure cylinder 35 is fastened on the apparatus carrier 16, preferably on a lateral surface 42, by means of a supporting bracket 43. An alignment of the longitudinal central axis 23 of the pressure cylinder 35 and therefore of the penetration tool 9 to optimise the penetration process is effected by pivoting the apparatus carrier 16 by means of the lifting drive 20 about the lifting axis 17 running perpendicular to the tilt-up plane 18 of the cantilever arm 3, i.e. by pivoting the apparatus carrier 16 about the lifting axis 17, the longitudinal central axis 23 of the penetration tool 9 and the longitudinal central axis 30 of the spray unit tube 6 are jointly pivoted in the tilt-up plane 18 or a plane 44 running parallel thereto. Independently of this, the spray unit tube 6 can be twisted about the axis of rotation 27 running perpendicular to the lifting axis 17 by means of the rotary drive 28 in order to twist the spray unit tube 6 into a position in which no collision with the penetration tool 9 or the wall structure 11 to be penetrated can take place in a case of deployment of the penetration fixture 8.

For a deployment of the spray unit tube 6, an adjustment is achieved by means of the lifting axis 17 and the axis of rotation 27 according to a biaxial coordinate system, with the result that an optimal alignment of an extinguishing jet is achieved, according to arrow 7, regardless of the position of the cantilever arm 3.

Figure 3:
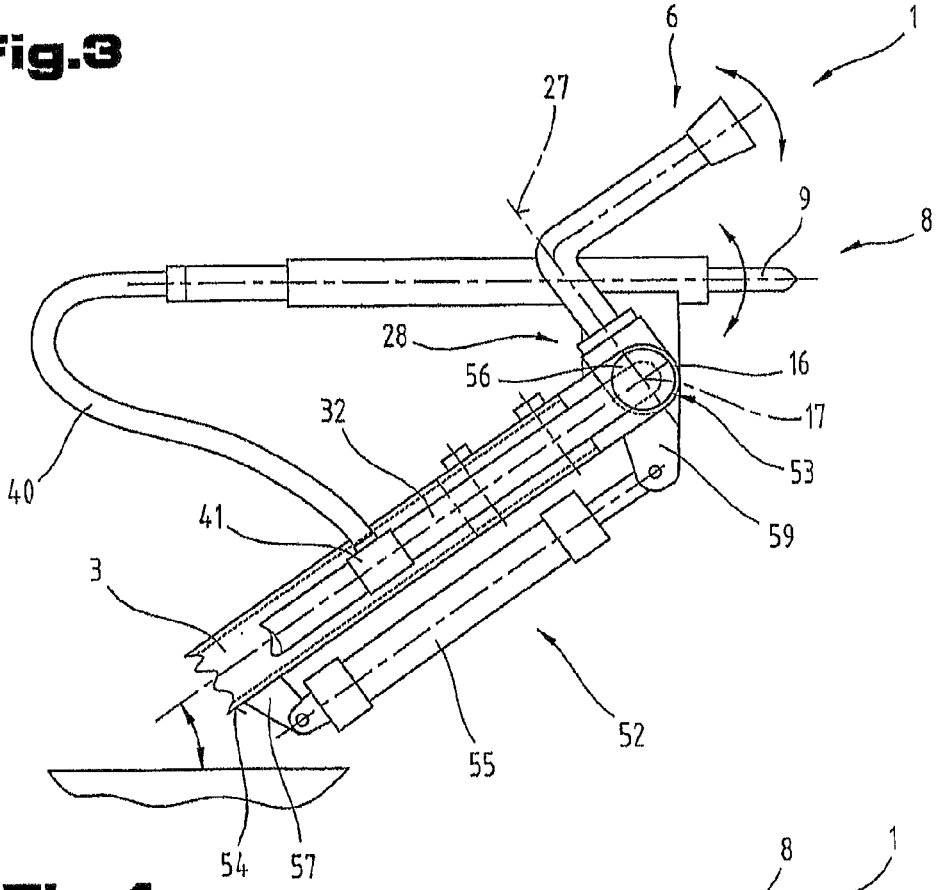
FIG. 3 shows a view of another embodiment of the device for use in fire-fighting operations according to the invention.
Figure 4:
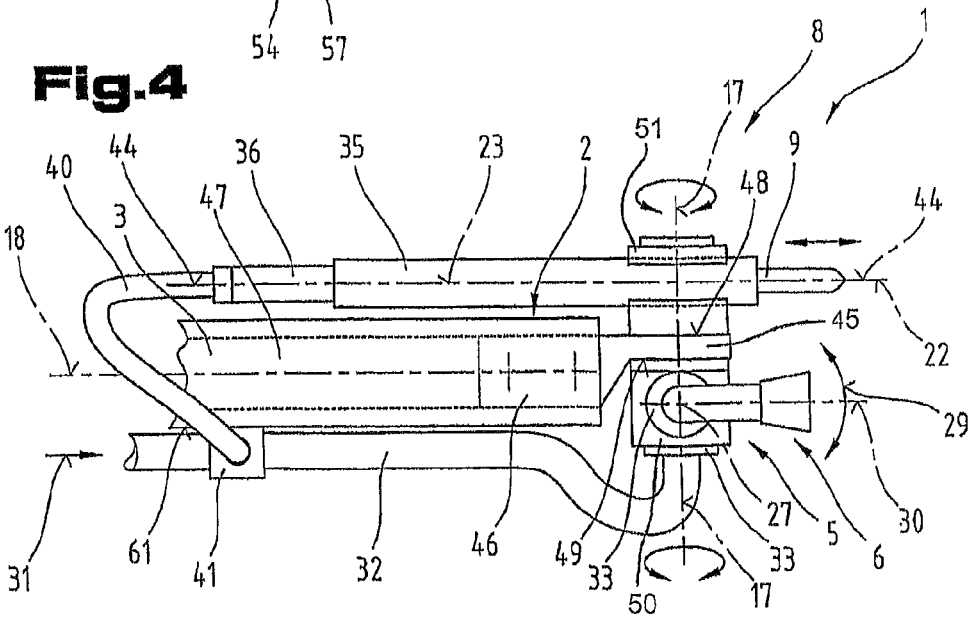
FIG. 4 shows a plan view of the device for use in fire-fighting operations from FIG. 3.

FIGS. 3 and 4 show another embodiment of the extinguishing device 1. In the following description, the terms and reference numerals already provided are used for the components already contained and described in the preceding figures.

In the end region 2 of the cantilever arm 3, there is provided as the apparatus carrier 16 a plate-shaped bracket 45 which is aligned in the tilt-up plane 18 of the cantilever arm 3, and which projects beyond this, said bracket projecting via a profile extension 46 into a hollow profile 47 forming the cantilever arm 3 and being rigidly fastened. The plate-shaped bracket 45 mounts, on opposed lateral surfaces 48, 49, the spray unit head 5 with the spray unit tube 6 and the penetration fixture 8 with the pressure cylinder 35 with the piston rod 36 configured as a hollow penetration tool 9. The spray unit head 5 and the penetration fixture 8 are each pivotally mounted in bearing arrangements 50, 51, forming the lifting axis 17, which runs at a right angle to the tilt-up plane 18. Independent lifting drives 52, 53 ensure an independent pivoting of the spray unit head 5 and the penetration fixture 8 for alignment of their longitudinal central axes 23, 30 in the tilt-up plane 18 or in the plane 44 running parallel thereto.

In the exemplary embodiment shown, a lifting drive 52 is, for example, a double-acting pressure cylinder 55, which can be subjected to a pressure medium, disposed, for example, on an underside 54 of the cantilever arm 3. As further shown however, a rotary drive 56 is also possible, e.g. a hydraulic motor, electric servomotor etc. which directly effects a lifting adjustment of the spray unit head 5 and/or the penetration fixture 8 about the lifting axis 17 according to double arrows. The pressure cylinder 55 is supported by means of a bearing block 57 with respect to the cantilever arm 3 and is mounted on the piston rod side on a steering lever 59 of the spray unit head 5 or the penetration fixture 8.

As has already been described previously, the spray unit tube 6 is further mounted in the swivel arrangement 26 so that it is rotatable about the axis of rotation 27 running perpendicular to the lifting axis 17 and can be rotated by means of the rotary drive 28 on the spray unit head 5, according to double arrow 29.

The spray unit tube 6 and the penetration tool 9 are supplied with the extinguishing medium, according to arrow 31, by means of the conduit 32 guided longitudinally and fastened, for example on a lateral surface 61 and via the valve 41 and pressure hose 40 into the hollow penetration tool 8 or by means of the conduit 32 and the rotary connection 33 provided concentrically to the lifting axis 17 and the axis of rotation 27 into the spray unit head 5 and further into the spray unit tube 6.

Figure 5:
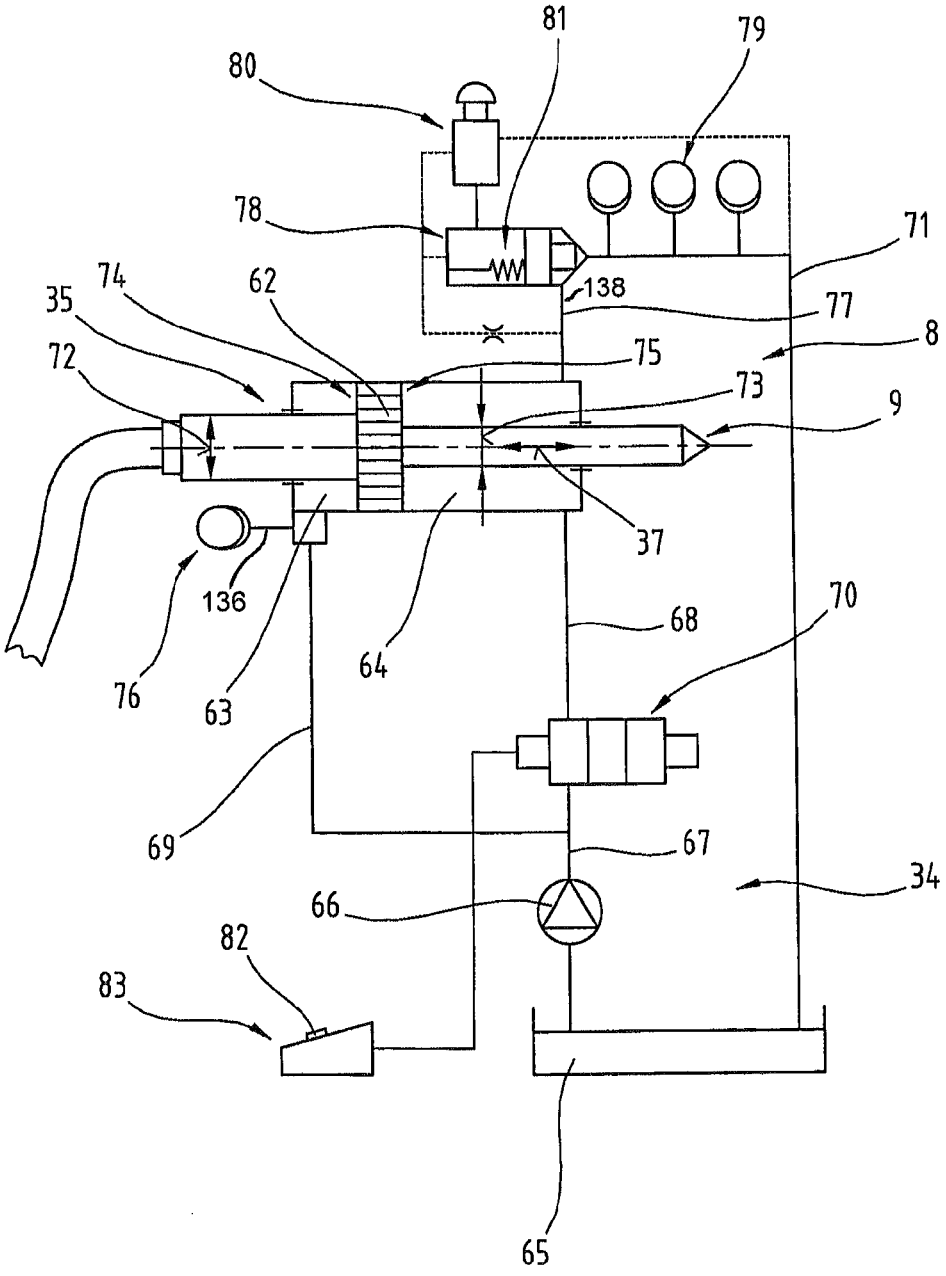
FIG. 5 shows a hydraulic system according to the invention for operating the device for use in fire-fighting operations according to the invention in a simplified schematic view.

FIG. 5 shows a possible embodiment of the hydraulic system 34 provided for acting upon the pressure cylinder 35 of the penetration fixture 8 with the pressure medium in a simplified hydraulic diagram.

The pressure cylinder 35 forms the linear drive 10 for adjustment of the penetration tool 9 which is part of the continuous piston rod 36 and which moves between an extended position and a retracted position by corresponding action upon pressure chambers 63, 64 separated from one another by a piston 62 of the piston rod 36 by the pressure medium from a tank 65. From a pump 66 a pressure line 67 and a feed line 68 lead into the pressure chamber 64 for the retraction movement and a bypass line 69 leads into the pressure chamber 63 for the extension movement of the piston rod 36. The bypass line 69 connects the pressure line 67 directly to the pressure chamber 63 whilst for supplying the pressure chamber 64 a preferably remotely triggerable control valve 70 is provided in the feed line 68. As a result of this line and valve arrangement, the pressure chamber 63 is acted upon directly with the operating pressure whilst the pressure chamber 64 is optionally subjected to the medium pressure by means of the control valve 70. From the pressure chamber 64 a return line 71 leads via a control and regulating device still to be described in detail for removing the medium into the tank 65.

The penetration tool 9 or the piston rod 36 is formed in the pressure chamber 63 which brings about the extension movement of the penetration tool 9 with a diameter 72 which is larger than a diameter 73 in the pressure chamber 64 which brings about the retraction movement, with the result that different piston active areas 74, 75 are obtained and piston active area 74 which effects the extension movement is smaller than the piston active area 75 which effects the retraction movement. Thus, in general when both pressure chambers 63, 64 are subjected to the same medium pressure, this results in a displacement of the penetration tool 9 into the retracted end position which is limited by a piston travel, due to a resulting restoring force as a consequence of the area ratios of the piston active areas 74, 75.

In this case, the control valve 70 is in a switching position which produces a line connection between the pump 66 and the pressure chamber 64 whilst the bypass line 69 supplying the further pressure chamber 63 with the pressure medium forms a direct connection from the pump 66 to the pressure chamber 63.

At least one pressure accumulator element 76, e.g. a bubble accumulator, piston accumulator, membrane accumulator etc. is provided in fluid communication with the pressure chamber 63 and the bypass line 69, in order to have a large volume of pressurised pressure medium available immediately upstream of the pressure chamber 63 for an extension movement of the penetration tool 9 without substantial line losses, with the result that a high acceleration and final velocity of the penetration tool 9 is achieved.

A further control valve 78, from which the return line 71 leads into the tank 65, is located immediately at an output 77 or in the return line 71 for optional pressure relief of the pressure chamber 64 opposite the pressure chamber 63 for the extension movement.

The control valve 70 has a large flow cross-section in order to achieve a rapid expansion of the pressure chamber 64 and at least one further pressure accumulator element 79 is provided for intermediate storage of the medium in addition to the fluid communication to the return line 71. Thus, a braking effect during the extension movement of the penetration tool 9, caused by a flow resistance in the relatively long return line 71 is prevented and this makes it possible to keep the dimension of the bypass line 69 small.

Figure 10:
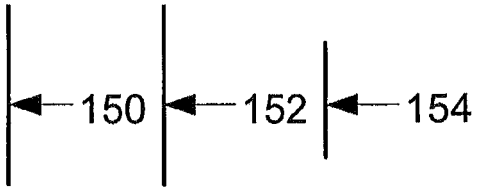
FIG. 10 shows a comparison of diameters of flow cross-sections of flow connections with respect to a return line.

For accomplishing an extension movement of the penetration tool 9, the control valve 70 located in the feed line 68 between the pump 66 and the pressure chamber 64 which brings about the retraction movement is shifted into a locked position and the control valve 78 at the outlet 77 of the pressure chamber 64 is shifted into an open position and the pressure chamber 63 which brings about the extension movement is subjected to the pressure medium from the directly upstream pressure accumulator element 76 plus the medium flow of the pump 66. In particular, as a result of the pressure medium stored in the pressure accumulator element 76 at a high pressure level corresponding to the operating pressure, a high acceleration of the extension movement for a penetration process and a high final velocity of the penetration tool 9 is achieved. A first flow connection 136 between the pressure chamber 63 of the pressure cylinder and the pressure accumulator element 76 and a second flow connection 138 between the pressure chamber 64 and the further pressure accumulator element 79 have a larger flow cross-section than a flow cross-section of the return line 71. FIG. 10 shows that for the embodiment with circular lines, the diameter 150 of the flow-cross section of the first flow connection 136 is larger than the diameter 154 of the flow-cross section of the return line 71, and the diameter 152 of the flow-cross section of the second flow connection 138 is also larger than the diameter 154 of the flow-cross section of the return line 71.

A switching valve 80 for an opening process against a spring arrangement 81 which brings about a closed position is preferably assigned to the control valve 78. The switching of the control valve 70 and the control valve 78 is preferably remotely controllable by means of a control means 82, e.g. at a control panel 83 and line connection for a signal transmission, wherein a wireless signal transmission switching the control valve 70 and the control valve 78 or the switching valve 80 is also possible.

Figure 6:
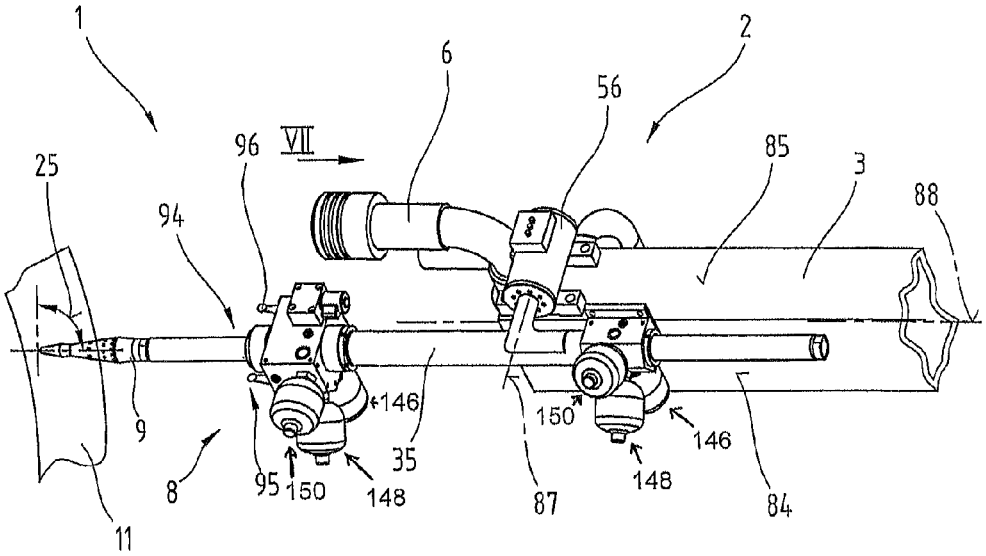
FIG. 6 shows another embodiment of the device for use in fire-fighting operations in a simplified perspective view.
Figure 7:
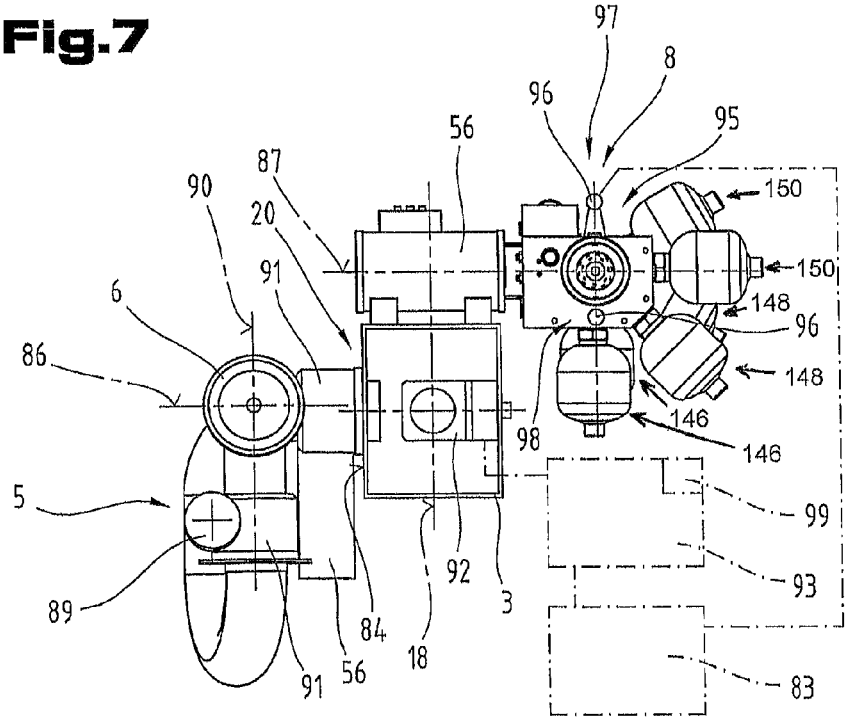
FIG. 7 shows the embodiment viewed along the arrow VII in FIG. 6.

FIGS. 6 and 7 show another embodiment of the extinguishing device 1. According to this embodiment, the spray unit head 5 with the spray unit tube 6 and the penetration fixture 8, consisting of the pressure cylinder 35 with the penetration tool 9 are disposed in the end region 2 of the cantilever arm 3 as independent structural modules. According to this exemplary embodiment, the spray unit head 5 is disposed on a lateral surface 84 of the cantilever arm 3 and the pressure cylinder 35 is disposed on an upper side 85 of the cantilever arm 3 in each cases via a lifting drive 20, e.g. the hydraulic or electrical rotary drive 56 so that they can be pivoted about lifting axes 86, 87 running parallel to one another and at right angles to the tilt-up plane 18. Thus, both the spray unit head 5 with the spray unit tube 6 and the pressure cylinder 35 with the penetration tool 9 are pivotable in planes parallel to the tilt-up plane 18 at a predefinable angle to a longitudinal central axis 88 of the cantilever arm 3. In addition, the spray unit tube 6 is rotatable with respect to the spray unit head 5 by means of a further rotary drive 89 about an axis of rotation 90 running perpendicular to the lifting axis 86. The extinguishing medium for dispensing with the spray unit tube 6 is supplied by rotary distributor 91. The pressure accumulator elements are formed by bubble storage devices 150, by membrane storage devices 148, or by piston storage devices 146.

As can be further deduced from the figures, a camera 92 is disposed in the end region 2 of the cantilever arm 3, preferably in a protected position inside a hollow profile of the cantilever arm 3. The camera is preferably remotely controllable, for example, by means of signal and control lines or in a wireless manner by radio signal transmission, both the camera settings and also their alignment to a desired field of view.

As has been described previously, a control and monitoring device 93 is, for example, integrated in the control panel 83 which is provided at a command position not shown further or the control station of an emergency vehicle and for example comprises the necessary control and communication means, monitor etc.

According to a further preferred embodiment, the penetration fixture 8 or the pressure cylinder 35 at a protruding end 94 is equipped with a detection device 95 comprising measuring and/or scanning means 96 which is connected in communication with the control and monitoring means 93 for transmitting measurement signals relating to an angular alignment of the penetration tool 9 to the wall structure 11 to be penetrated.

The detection device 95 with the measuring and/or scanning means 96 can be based on a distance measurement with proximity sensors, laser measurement, ultrasound measurement etc. and serves in conjunction with the lifting drive 20 for the penetration fixture 8 for automatic positioning for an approximately rectangular alignment of the penetration tool 9 onto the cell structure.

Another possibility for positioning the penetration fixture 8 to achieve an almost right-angled alignment of the penetration tool 9 by means of the rotary drive 56 in relation to the wall structure 11 consists in providing a light beam emitter 97 and a light reflection receiver 98 instead of the measuring and scanning means 96, on the pressure cylinder 35, facing the wall structure 11 as detection device 95. Thus, in preparation for a penetration process a light beam is focussed by means of the light beam emitter onto the wall structure 11 and by lifting adjustment about the lifting axis 87, the position at which the highest light intensity is detected by means of the light reflection receiver 98 is determined in an evaluation switching module 99 which is achieved when the angle of incidence is about 90°.

Figure 8:
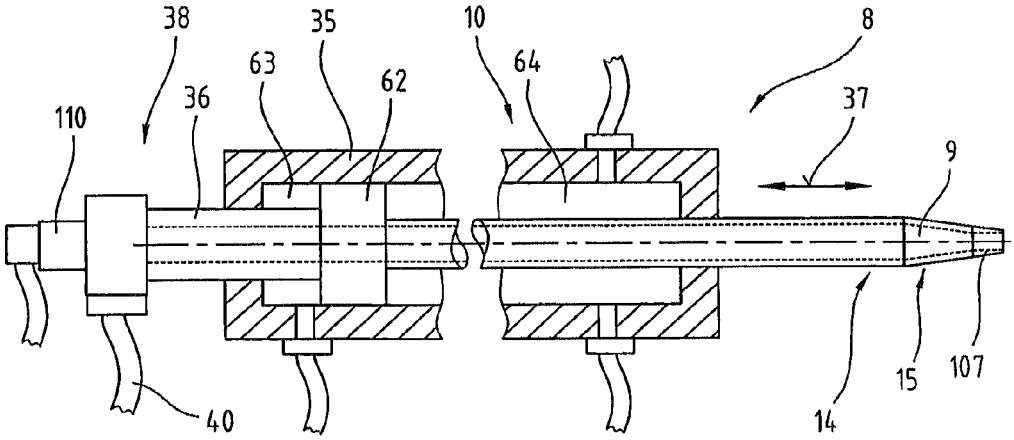
FIG. 8 shows a penetration fixture for a device for use in fire-fighting operations, in partially cutaway view.
Figure 9:
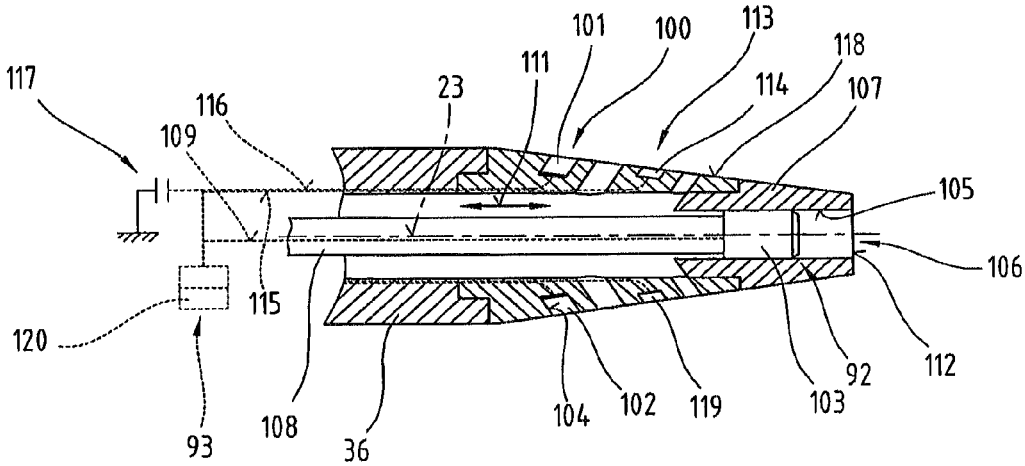
FIG. 9 shows a detailed view of the penetration fixture, in cutaway view.

FIGS. 8 and 9 show another possible and optionally independent embodiment of the penetration fixture 8 and it should be noted at this point that penetration fixture 8 shown and described is only reproduced as an example for a plurality of possible embodiments. In order to avoid unnecessary repetition, reference is made to or account is taken of the detailed description in the preceding FIGS. 1 to 7 and the same component designations or reference numerals as in the preceding FIGS. 1 to 7 are used for the same components.

The penetration fixture 8 has, for example, the pressure cylinder 35 as the linear drive 10, said pressure cylinder being provided with a continuous hollow piston rod 36 and being formed by the pressure chambers 63, 64 which are separated from one another by the piston 62, the pressure chambers being designed for adjustment of the piston rod, according to double arrow 37, by respective action with the pressure medium. In the protruding end 14, the piston rod 36 is provided with the frustro-conical penetration tool 9 which is configured as the nozzle head 15. At the opposite end 38, the hollow piston rod and the hollow penetration tool 9 are supplied via the pressure hose 40 with the extinguishing medium, which in the case of application is dispensed via approximately radially running nozzle holes of the penetration tool 9 for fighting a scene of fire.

As can be further deduced from FIG. 9 in particular, the penetration tool 9 is fitted with a communication and/or detection means 100 which, for example, comprises a loudspeaker 101, microphone 102 and camera 92, in particular a lens 103 fitted with a CCD chip.

According to a preferred embodiment, approximately radially incorporated receptacles 104 for protected integration of the loudspeaker 101 and microphone 102 are provided, for example, over the circumference of the cone surface of the penetration tool 9.

As can be further deduced from FIG. 9, for example, the camera 92 or the lens 103 with the CCD chip is disposed in a central hole 105 of a penetration insert 107 forming a hollow tip 106 and is mounted in said hole by means of a protective tube 108 running the full depth of the piston rod 36 in the longitudinal direction, which is used for the secured through-guidance of a data line 109 or a light guide etc. so that it can be adjusted by means of an adjusting drive 110 disposed at the end 38 of the piston rod 36, according to double arrow 111.

This has the result that the camera 92 can be adjusted during a penetration process with the penetration insert 107 into a withdrawn position and after the penetration process has taken place, it can be adjusted into a functional position slightly outside a knife edge seal 112 of the penetration insert 107 to create a comprehensive field of view.

The penetration insert 107 is preferably made of a high-strength metal alloy e.g. high-speed steel, hard metal etc. in order to avoid deformations at the knife edge seal 112 and to achieve an optimal penetration process.

As can be further deduced from FIG. 9, it is also possible to integrate light sources 113, e.g. LEDs 114 in the cone surface of the penetration tool 9 in order to optionally provide illumination in the near region of the penetration tool 9.

As has already been mentioned, according to a preferred embodiment, a data line 109 or a light guide run in the protective tube 108 running approximately coaxially in the bore of the piston rod 36.

Lines 115 for the communication connection and power supply of the loudspeaker 101, microphone 102 and light source 113 are, for example, laid in one or several grooves 116 which are provided in the inner bore of the piston rod 36 and run the full length thereof in the longitudinal direction and are, for example, protected with a potting compound in these grooves 116.

It is further noted that the data line 109 of the camera 92 and the lines 115 are connected in line to the control and/or monitoring device 93 for evaluating the signals and conversion into control measures for the adjustment of the penetration device and also an energy source 117.

Furthermore, according to a preferred embodiment, as can also be deduced from FIG. 9, at least one sensor 119, e.g. temperature measurement sensor, gas probe etc. is disposed in an integrated manner in one of the receptacles 104 which forms a recess in a surface 118 of the penetration tool 9 for a protected arrangement of the communication and/or detection means 100, which sensor is also connected, for example, in communication with the evaluation circuit 120 provided in the control and/or monitoring device 93 with the result that further essential information for an optimised deployment such as, for example, room temperature, air condition, gas contamination, gas concentration etc. are available to the task force.

It is also mentioned that the camera 93 described in the exemplary embodiment is known from medical application and also from micromechanics and inter alia also bears the designation digital camera, video endoscope etc. and the image recorded by the lens is digitised by the integrated CCD chip and the digital data are subsequently fed, by means of a processor, for example for output to a monitor and/or data storage device. Such digital cameras are suitable wherever the smallest dimensions are desired for an inspection device.

The exemplary embodiments show possible embodiments of the device for use in fire-fighting operations and the penetration fixture, wherein it should be noted at this point that the invention is not restricted to the specially depicted embodiments of the same but rather various combinations of the individual embodiments amongst one another are possible and this possibility for variation lies within the ability of the person skilled in the art who is active in this technical field as a result of the teaching on the technical action by the present invention. Thus, all feasible embodiments which are possible by combining individual details of the embodiments depicted and described are covered by the scope of protection.

For the sake of good order, it should finally be noted that for a better understanding of the structure of the device for use in fire-fighting operations and the penetration fixture, said device or its components are shown partially not to scale and/or enlarged and/or reduced in size.

The object forming the basis of the independent inventive solutions can be deduced from the description.

In particular, the individual explanations shown in FIGS. 1, 2; 3, 4; 5; 6, 7; 8, 9 form the subject matter of independent solutions according to the invention. The relevant objects and solutions according to the invention can be deduced from the detailed descriptions of these figures.

REFERENCE LIST

1 Extinguishing device
2 End region
3 Cantilever arm
4 Standing surface
5 Spray unit head
6 Spray unit tube
7 Arrow
8 Penetration fixture
9 Penetration tool
10 Linear drive
11 Wall structure
12 Interior
13 Cell
14 End
15 Nozzle head
16 Apparatus carrier
17 Lifting axis
18 Tilt-up plane
19 Pivot bearing arrangement
20 Lifting drive
21 Double arrow
22 Longitudinal central axis
23 Longitudinal central axis
24 Double arrow
25 Angle of incidence
26 Swivel arrangement
27 Axis of rotation
28 Rotary drive
29 Double arrow
30 Longitudinal central axis
31 Arrow
32 Conduit
33 Rotary distributor
34 Hydraulic system
35 Pressure cylinder
36 Piston rod
37 Double arrow
38 End
39 Feed line
40 Pressure hose
41 Valve
42 Lateral surface
43 Support bracket
44 Plane
45 Bracket
46 Profile extension
47 Hollow profile
48 Lateral surface
49 Lateral surface
50 Bearing arrangement
51 Bearing arrangement
52 Lifting drive
53 Lifting drive
54 Underside
55 Pressure cylinder
56 Rotary drive
57 Bearing block
58
59 Steering lever
60
61 Lateral surface
62 Piston
63 Pressure chamber
64 Pressure chamber
65 Tank
66 Pump
67 Pressure line
68 Feed line
69 Bypass line
70 Control valve
71 Return line
72 Diameter
73 Diameter
74 Piston active area
75 Piston active area
76 Pressure accumulator element
77 Output
78 Control valve
79 Pressure accumulator element
80 Switching valve
81 Spring arrangement
82 Control means
83 Control panel
84 Lateral surface
85 Upper side
86 Lifting axis
87 Lifting axis
88 Longitudinal central axis
89 Rotary drive
90 Axis of rotation
91 Rotary distributor
92 Camera
93 Control and/or monitoring device
94 End
95 Detection device
96 Measurement and/or scanning means
97 Light beam sensor
98 Light reflection receiver
99 Evaluation switching module
100 Communication and/or detection means
101 Loudspeaker
102 Microphone
103 Objective
104 Receptacle
105 Central hole
106 Hollow tip
107 Penetration insert
108 Protective tube
109 Data line
110 Adjusting drive
111 Double arrow
112 Knife edge seal

113 Light source
114 LEDs
115 Line
116 Groove
117 Energy source
118 Surface
119 Sensor
120 Evaluation circuit

What is claimed is:

1. A penetration fixture having a tubular penetration tool and a linear drive for the tubular penetration tool, wherein the tubular penetration tool is provided with a nozzle head for dispensing a fire-extinguishing medium from a fire-extinguishing medium supply device after the tubular penetration tool penetrates into an interior space of a room unit enclosed by a wall, wherein the nozzle head is provided with at least one receptacle, the at least one receptable being recessed to a surface and being arranged entirely in a wall thickness of the nozzle head, wherein a communication device is disposed in the at least one receptacle, said communication device being connected in communication with a control device, wherein the penetration fixture has a detection device having a scanning device disposed at one end of the penetration tool, and wherein the detection device is formed by a light beam emitter and a reflection receiver connected in communication with an evaluation switching module of the control device.

2. The penetration fixture according to claim 1, wherein the communication device is formed by a loudspeaker.

3. The penetration fixture according to claim 1, wherein the communication device is formed by a microphone.

4. The penetration fixture according to claim 1, wherein the communication device is formed by a camera.

5. The penetration fixture according to claim 1, wherein the communication device is formed by a sensor.

6. The penetration fixture according to claim 1, wherein the communication device is formed by an LED disposed in the receptacle.

7. The penetration fixture according to claim 1, wherein a lens is mounted adjustably in a central hole running coaxially to the longitudinal central axis of an insert.

8. The penetration fixture according to claim 7, wherein the lens is drivingly connected to an adjusting drive disposed at one end of a piston rod via a protective tube accommodating a data line and crossing the piston rod in the longitudinal direction.

9. The penetration fixture according to claim 1, wherein the communication device is connected in line with the control device.

10. The penetration fixture according to claim 6, wherein at least one of the communication device and the LED is connected in line with an energy source.

* * * * *